US011707126B2

(12) United States Patent
Cho

(10) Patent No.: US 11,707,126 B2
(45) Date of Patent: Jul. 25, 2023

(54) COSMETIC CONTAINER

(71) Applicant: TAESUNG INDUSTRIAL CO., LTD., Anyang-si (KR)

(72) Inventor: Min Jun Cho, Goyang-si (KR)

(73) Assignee: TAESUNG INDUSTRIAL CO., LTD., Anyang-si (KR)

( * ) Notice: Subject to any disclaimer, the term of this patent is extended or adjusted under 35 U.S.C. 154(b) by 0 days.

(21) Appl. No.: 17/589,335

(22) Filed: Jan. 31, 2022

(65) Prior Publication Data

US 2023/0031177 A1 Feb. 2, 2023

(30) Foreign Application Priority Data

Aug. 2, 2021 (KR) ..... 10-2021-0101582

(51) Int. Cl.
*A45D 34/04* (2006.01)
*A45D 40/26* (2006.01)

(52) U.S. Cl.
CPC ..... *A45D 34/041* (2013.01); *A45D 40/261* (2013.01)

(58) Field of Classification Search
CPC .... A45D 34/041; A45D 40/261; B05C 17/02; B05C 17/0217; B05C 17/0227; B05C 17/025; B43K 7/005; B43K 1/08; B43K 1/082; B43K 1/084
USPC ..... 401/28, 209, 212, 216
See application file for complete search history.

(56) References Cited

U.S. PATENT DOCUMENTS 3,380,152 A * 4/1968 Wilcox ..... B43K 1/08 29/441.1
4,811,726 A * 3/1989 Goncalves ..... A61H 15/02 222/521
5,125,757 A * 6/1992 Morrison ..... A61H 15/02 401/23
5,131,384 A * 7/1992 Obagi ..... A61H 15/02 601/154
2018/0193219 A1* 7/2018 Hashimoto ..... A61H 7/005

FOREIGN PATENT DOCUMENTS

KR 20-0390638 Y1 7/2005
KR 20-2009-0007499 U 7/2009
(Continued)

OTHER PUBLICATIONS

Office Action dated Nov. 29, 2022, for corresponding Korean Patent Application No. 10-2021-0101582, along with an English machine translation (8 pages).

(Continued)

*Primary Examiner* — David J Walczak
(74) *Attorney, Agent, or Firm* — Hauptman Ham, LLP

(57) ABSTRACT

A cosmetic container includes a cosmetic container unit having a cosmetic storage space unit in which cosmetic storage space is formed; a ball-rolling support unit provided at one end of the cosmetic container unit to form a circular ring-shaped ball-rolling support concave groove; a massage ball holder which has a ball support hole surface unit having at least one ball support hole formed therein and is coupled to the cosmetic container unit such that the ball support hole is aligned to the ball-rolling support concave groove; and a massage ball installed to roll in a state in which a partial area thereof is exposed to the outside through the ball support hole and a part thereof is inserted in the ball-rolling support concave groove.

5 Claims, 13 Drawing Sheets

(56) References Cited

FOREIGN PATENT DOCUMENTS

| | | | |
|---|---|---|---|
| KR | 10-2009-0103156 | A | 10/2009 |
| KR | 20-0471503 | Y1 | 2/2014 |
| KR | 20-2016-0001303 | U | 4/2016 |
| KR | 20-0481202 | Y1 | 8/2016 |
| KR | 10-2020-0095718 | A | 8/2020 |
| KR | 10-2020-0105804 | A | 9/2020 |

OTHER PUBLICATIONS

Office Action dated Dec. 13, 2022, for corresponding Japanese Patent Application No. 2022-007990, along with an English translation (6 pages).

Response to the Korean office action (NPL No. 1) dated Nov. 29, 2022, for corresponding Korean Patent Application No. 10-2021-0101582, along with English machine translations (22 pages).

* cited by examiner

COSMETIC CONTAINER

CROSS-REFERENCE TO RELATED APPLICATION

This application is based upon and claims the benefit of priority from Korean Patent Application No. 10-2021-0101582, filed on Aug. 2, 2021 in the Korean Intellectual Property Office, the entire contents of which is incorporated herein by reference.

BACKGROUND OF THE INVENTION

1. Field of the Invention

The disclosure relates to a cosmetic container and, more specifically, to a cosmetic container including a cosmetic storage space appropriate for the usage and type of a cosmetic product, and a means for dispensing the cosmetic product stored in the cosmetic storage space.

2. Description of the Prior Art

Cosmetic products are widely used for various usages (for example, moisturizing, nutrition supply), and are produced according to respective usages in the type of powder, liquid, gel, cream, and solid (for example, lipsticks).

A cosmetic product is stored in a cosmetic container having a cosmetic storage space appropriate for the usage and type.

A user uses the cosmetic product little by little as needed, and the cosmetic container has, to this end, a means for dispensing the cosmetic product stored in the cosmetic storage space.

FIG. 12 is an exploded perspective view of a conventional cosmetic container, and FIG. 13 is a sectional view of the conventional cosmetic container.

The conventional cosmetic container, as illustrated in the drawings, includes: a cosmetic container unit 110 having a straight tube-type cosmetic storage space unit 111 having a concave cosmetic storage space 111*a* formed therein; a cosmetic container cap 121 coupled to the top of the cosmetic storage space unit 111 so as to surround the top opening of the cosmetic storage space unit 111; and a brush manipulation unit 180 installed on the cosmetic container cap 121.

The cosmetic container unit 110 includes, in addition to the cosmetic storage space unit 111, a cosmetic holder 130 installed on the inner lower side of the cosmetic storage space 111*a*, and an upward/downward movement operation unit 140 coupled to the bottom of the cosmetic storage space unit 111.

The cosmetic holder 130 is formed concave and has a spiral member 131 formed at the center thereof.

A cosmetic product 201 is installed in the cosmetic storage space 111*a* to be supported by the cosmetic holder 130.

The spiral member 131 has a coupling hole 131*a* formed along the height direction, and has a spiral groove formed on the inner surface of the coupling hole 131*a*.

The upward/downward movement operation unit 140 includes a rotation manipulation cap 141 and a screw rod 142 formed on the upper surface of the rotation manipulation cap 141.

The upward/downward movement operation unit 140, configured as described above, is coupled to the bottom of the cosmetic storage space unit 111 to be able to rotate with regard to the cosmetic storage space unit 111 through the rotation manipulation cap 141.

The upward/downward movement operation unit 140 is installed such that the screw rod 142 enters the cosmetic storage space 111*a*, and is coupled to the coupling hole 131*a*.

The brush manipulation unit 180 includes a pressing element 181 disposed outside the cosmetic container cap 121, and a brush 182 disclosed inside the cosmetic container cap 121.

The brush 182 is moved downwards by pressing manipulation of the pressing element 181.

A method for using the conventional cosmetic container, configured as above, will now be described with reference to FIG. 14.

When makeup is necessary, the cosmetic container cap 121 is separated from the cosmetic storage space unit 111.

The cosmetic storage space unit 111 is then held to rotate/rotate the rotation manipulation cap 141 such that the cosmetic product 201 is exposed to the outside past the top of the cosmetic storage space unit 111 (see FIG. 14).

The exposed cosmetic product is used for makeup.

Next, the cosmetic storage space unit 111 is held to rotate/manipulate the rotation manipulation cap 141 in the reverse direction such that the cosmetic product 201 is moved into the cosmetic product storage space unit 111.

Finally, the cosmetic container cap 121 is coupled to the cosmetic product storage space unit 111.

Meanwhile, the brush 182 may be smeared with the cosmetic product 201 by pressing/manipulating the pressing element 181 after separating the cosmetic container cap 121 from the cosmetic product storage space unit 111.

The cosmetic product 201 smeared on the brush 182 may be used for makeup.

However, the conventional cosmetic container has a problem in that, since no massage ball is installed, the cosmetic container cannot be used for massage.

In addition, there is another problem in that, since the rotation manipulation cap 141 is coupled to the bottom of the cosmetic product storage space unit 111, it is difficult to install a massage ball in the conventional cosmetic container such that little friction occurs during rolling operations, and assembly and washing are easy.

Korean Registered Utility Model Publication No. 20-0390638 (date of registration: Jul. 25, 2005) entitled "LIPSTICK CONTAINER HAVING BUTTON-TYPE APPEARING/DISAPPEARING BRUSH ROD", which is a relevant prior art document, discloses a technology regarding the above-described conventional cosmetic container.

SUMMARY OF THE INVENTION

Accordingly, it is an aspect of the disclosure to provide a cosmetic container having a massage ball installed to have less friction while rolling and to be easily assembled and washed.

In accordance with an aspect of the disclosure, a cosmetic container having a cosmetic container unit including a cosmetic storage space unit in which cosmetic storage space is formed may include: a ball-rolling support unit provided at one end of the cosmetic container unit to form a circular ring-shaped ball-rolling support concave groove; a massage ball holder which has a ball support hole surface unit having at least one ball support hole formed therein and is coupled to the cosmetic container unit such that the ball support hole is aligned to the ball-rolling support concave groove; and a massage ball installed to roll in a state in which a partial area thereof is exposed to the outside through the ball support hole and a part thereof is inserted in the ball-rolling support concave groove.

The ball-rolling support unit may include a circular tube-shaped ball support tube formed at one end of the cosmetic container unit to be disposed along a longitudinal direction of the cosmetic container unit, and a ball support column formed at one end of the cosmetic container unit to be disposed in the ball support tube such that the ball-rolling support concave groove is formed between the ball support tube and the ball support column, thereby reducing the space occupied by the ball-rolling support unit, and making it possible to bring the massage ball into forced contact with skin with a relatively little force.

The ball support tube may have a support tube ball support surface formed at an upper end thereof and forming a downward inclination toward the ball support column, and the ball support column may have a support column ball support surface formed at an upper end thereof and forming a downward inclination toward the ball support tube, thereby maintaining stable rolling operations of the massage ball.

The massage ball holder may further include a holder thick plate unit formed on an inner surface of the ball support hole surface unit; and the ball support hole may be formed to penetrate the holder thick plate unit, thereby maintaining stable rolling operations of the massage ball.

According to the disclosure, a ball-rolling support unit is provided at one end of a cosmetic container unit to form a circular ring-shaped ball-rolling support concave groove; a massage ball holder having a ball support hole surface unit having at least one ball support hole formed therein is coupled to the cosmetic container unit such that the ball support hole is aligned to the ball-rolling support concave groove; and a massage ball is installed to roll in a state in which a partial area thereof is exposed to the outside through the ball support hole and a part thereof is inserted in the ball-rolling support concave groove. Accordingly, the massage ball can be installed to have less friction while rolling and to be easily assembled and washed. Furthermore, the ball-rolling support concave groove is formed to have an circular ring shape so that the massage ball installation area and the number of installed massage balls can be selected in a wider range.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF THE EXEMPLARY EMBODIMENTS

Hereinafter, the disclosure will be described in detail with reference to the accompanying drawings.

Figure 1:
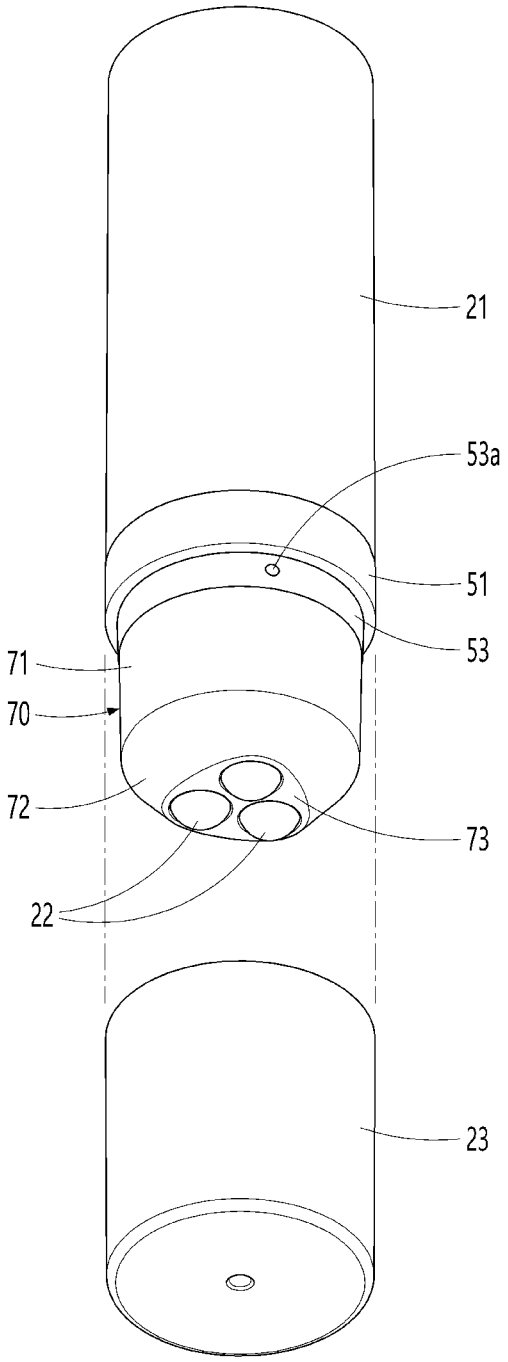
FIG. 1 and FIG. 2 are exploded perspective views of a cosmetic container according to an embodiment of the disclosure, respectively.
Figure 2:
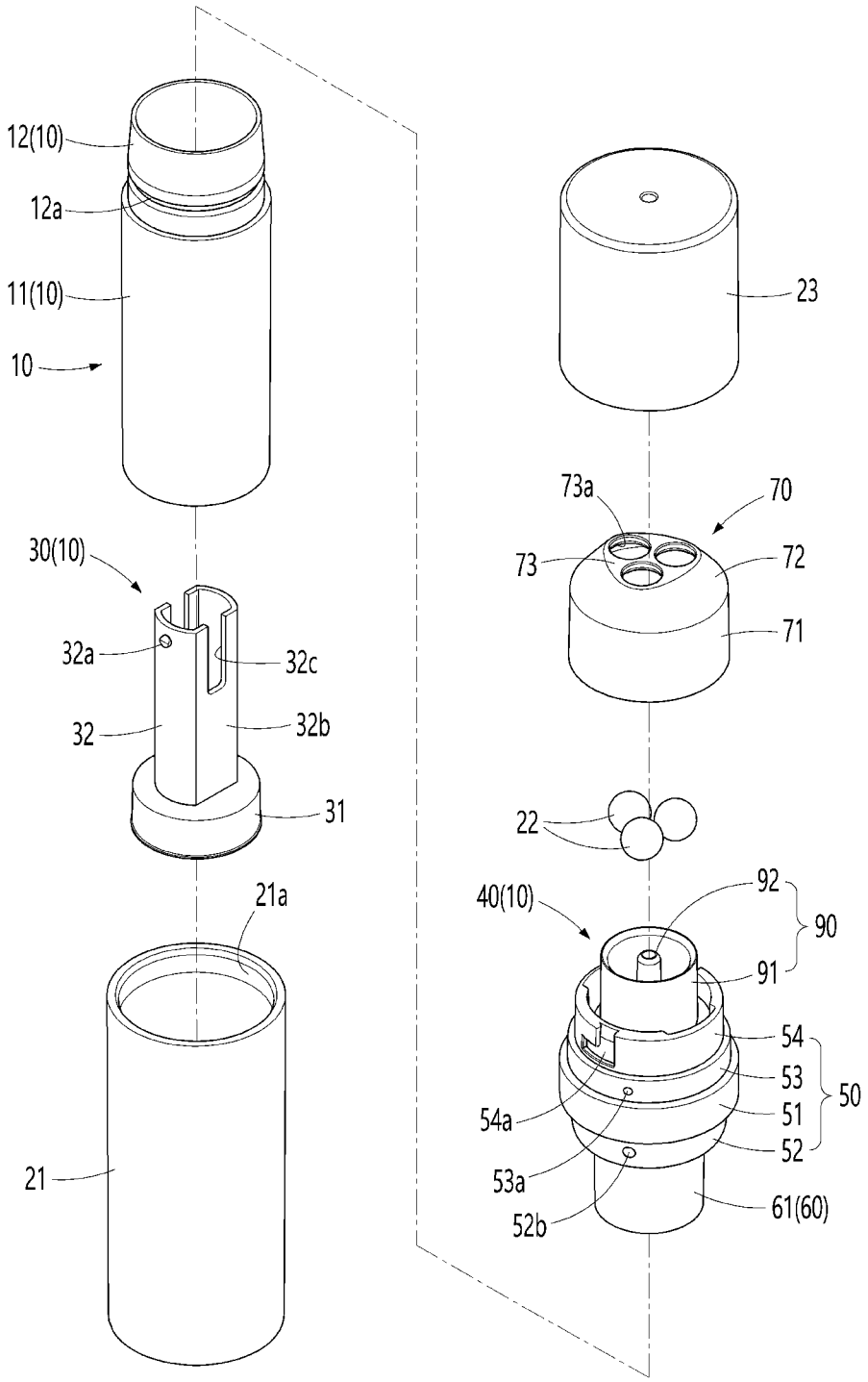
Figure 3:
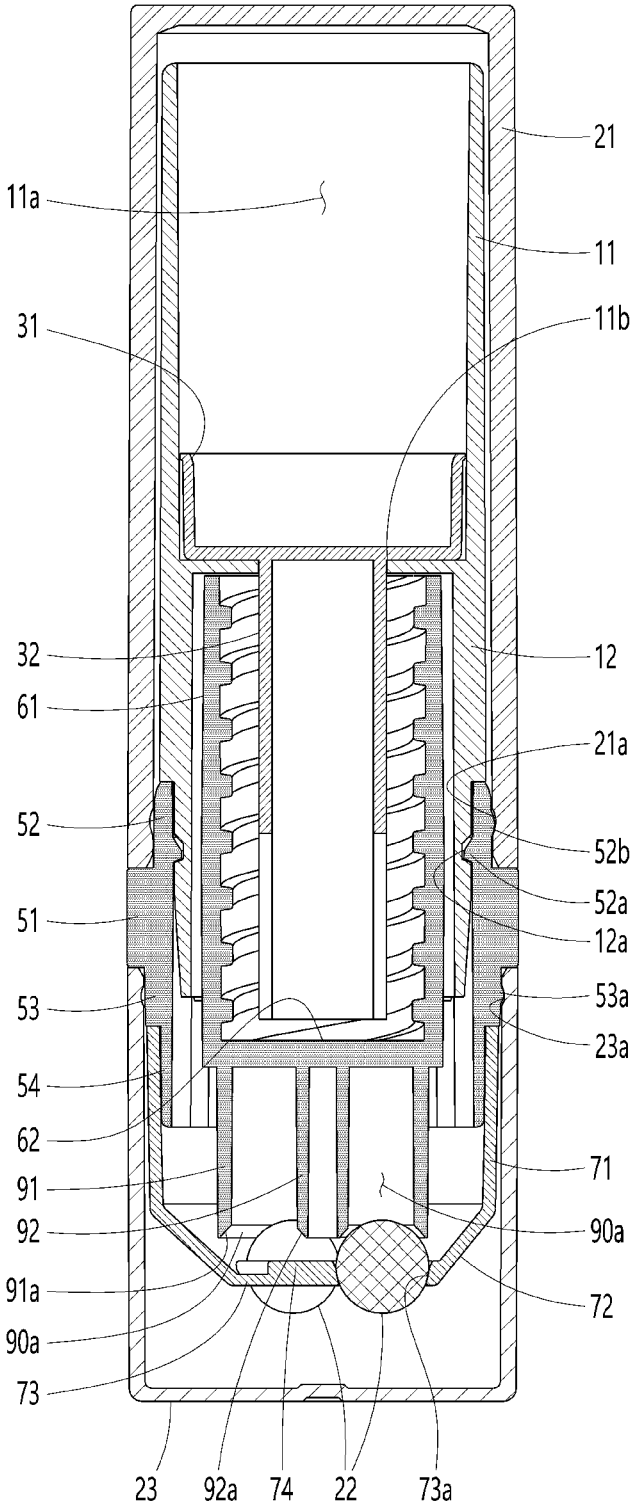
FIG. 3 is a cross-sectional view of a cosmetic container according to an embodiment of the disclosure.
Figure 4:
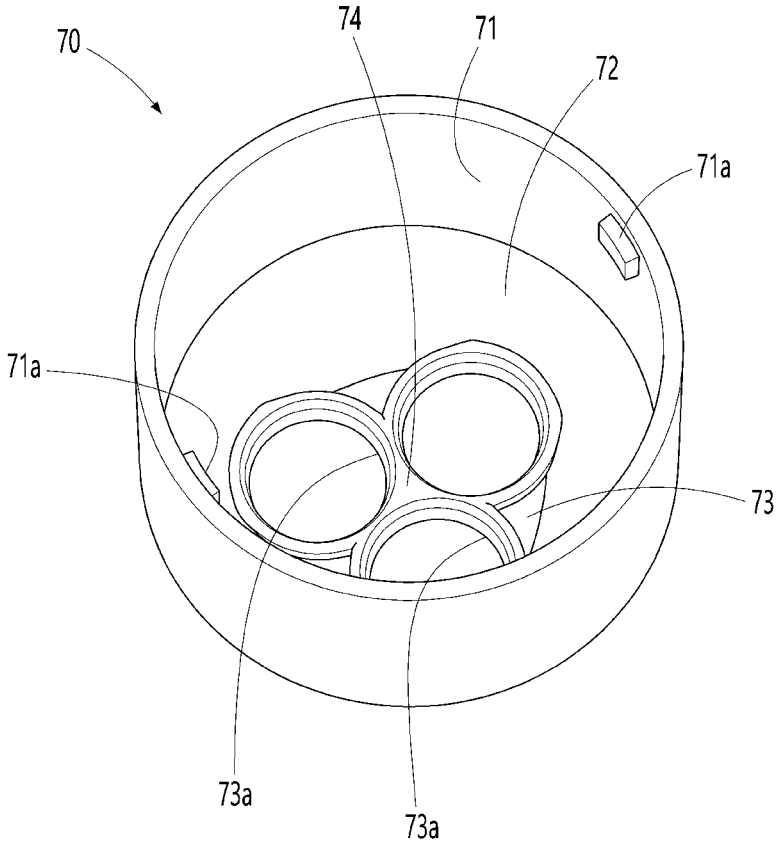
FIG. 4 is a perspective view of a massage ball holder according to an embodiment of the disclosure.
Figure 5:
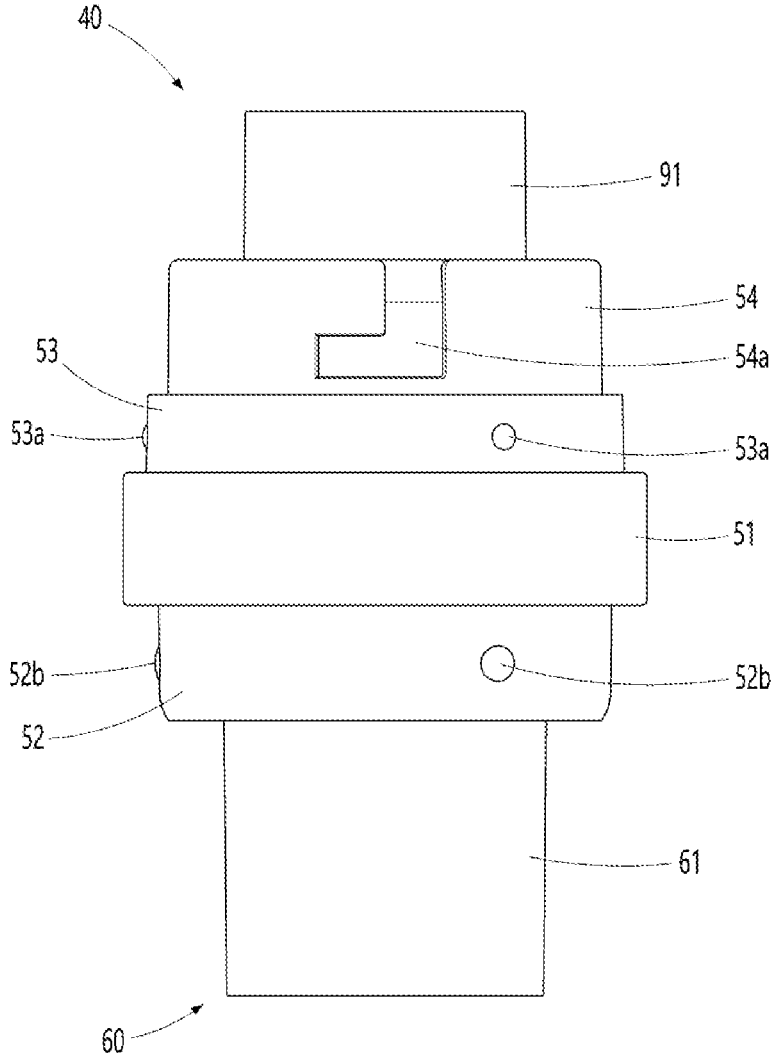
FIG. 5 is a front view of an upward/downward movement operation unit according to an embodiment of the disclosure.
Figure 6:
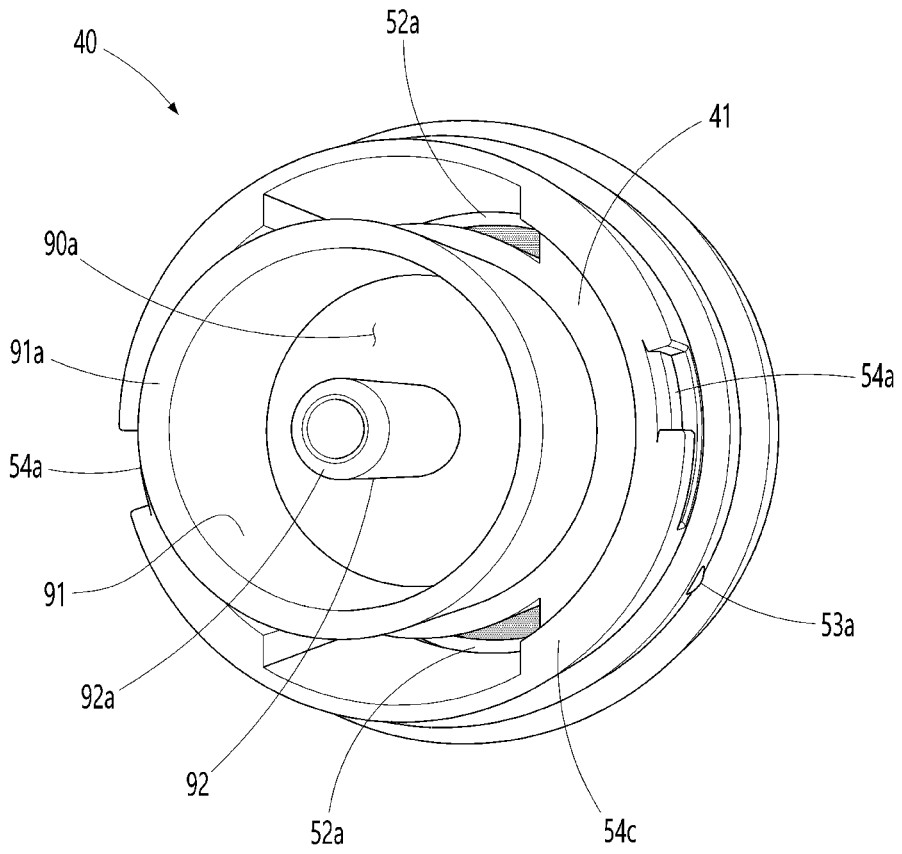
FIG. 6 is a perspective view of an upward/downward movement operation unit according to an embodiment of the disclosure.
Figure 7:
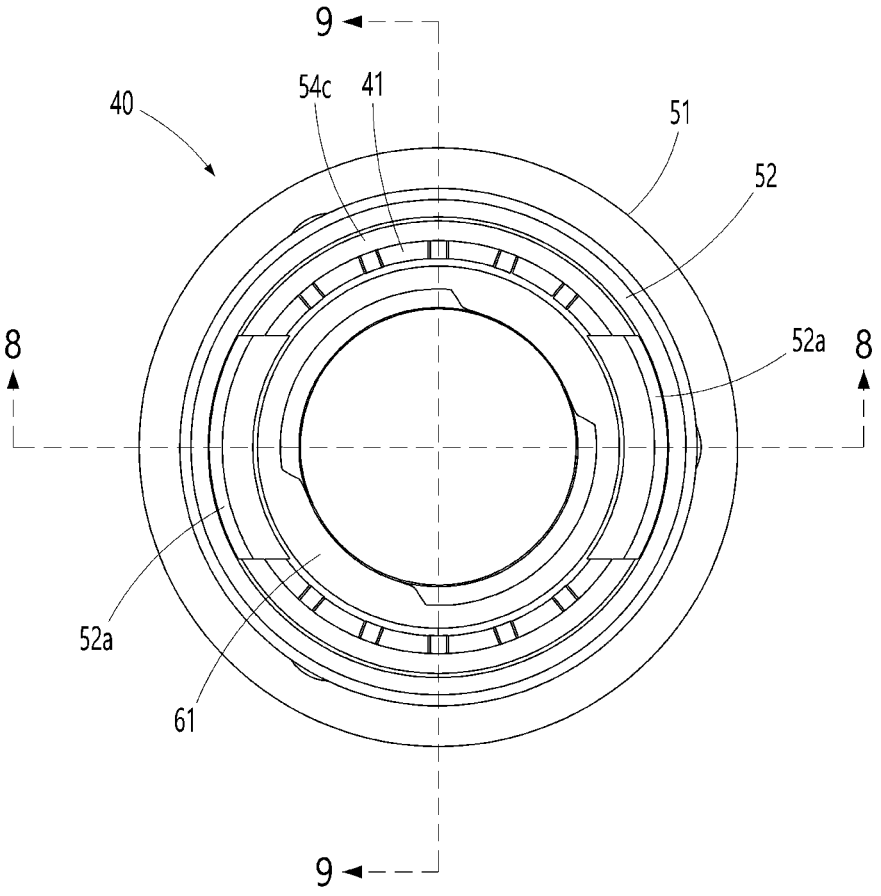
FIG. 7 is a plan view of an upward/downward movement operation unit according to an embodiment of the disclosure.
Figure 8:
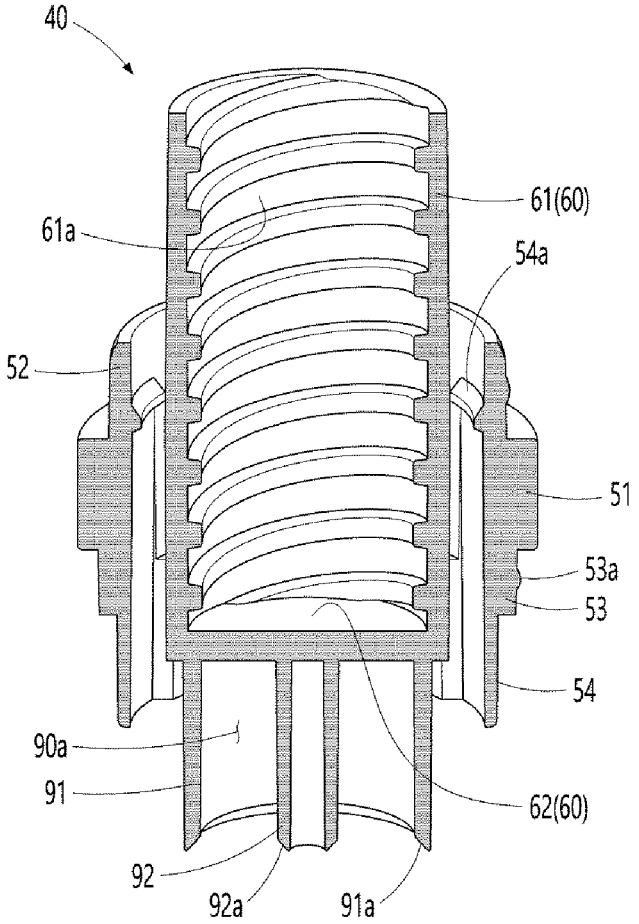
FIG. 8 is a perspective sectional view taken along the line 8-8 of FIG. 7.
Figure 9:
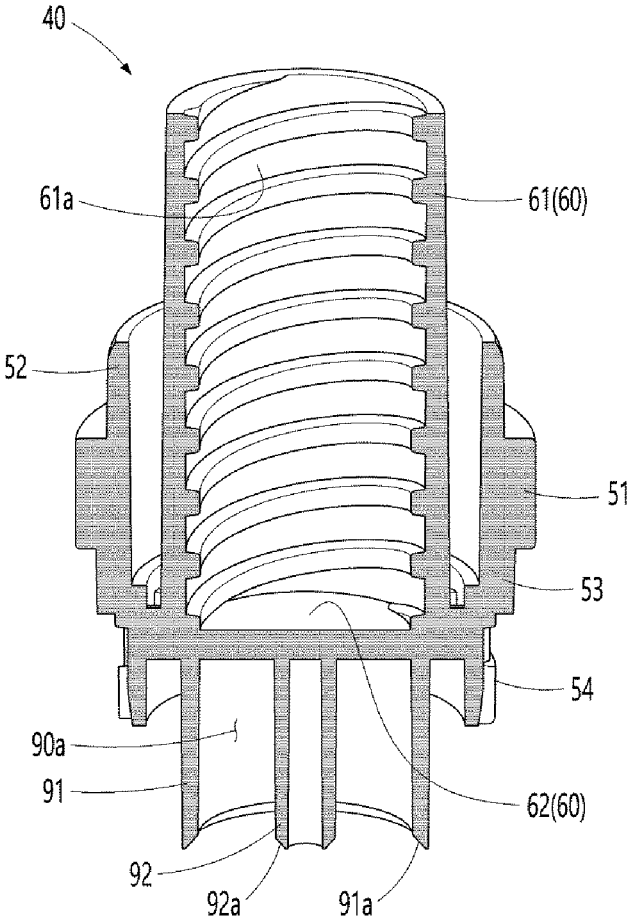
FIG. 9 is a perspective sectional view taken along the line 9-9 of FIG. 7.
Figure 10:
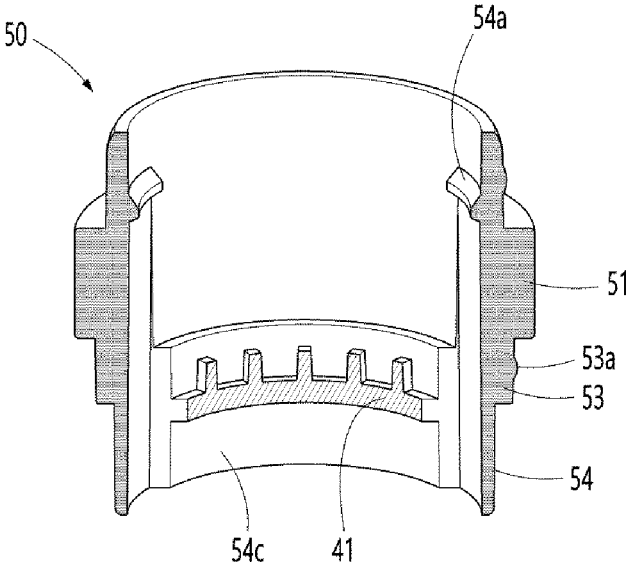
FIG. 10 is a view illustrating the reinforcing wall area in FIG. 8.
Figure 11:
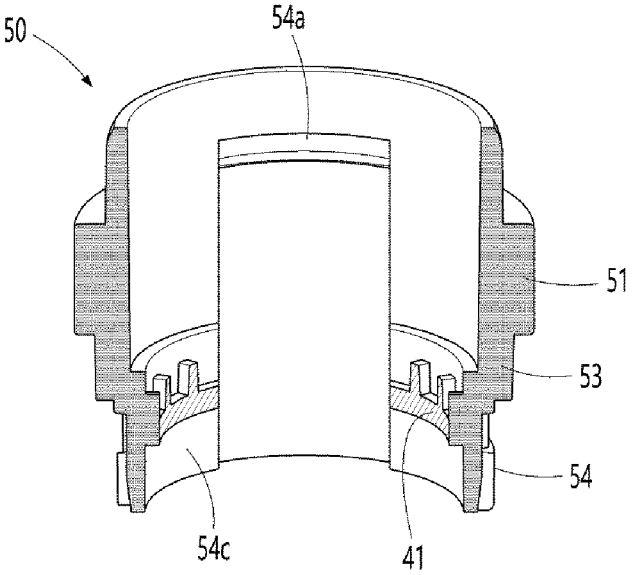
FIG. 11 is a view illustrating the reinforcing wall area in FIG. 9.
Figure 12:
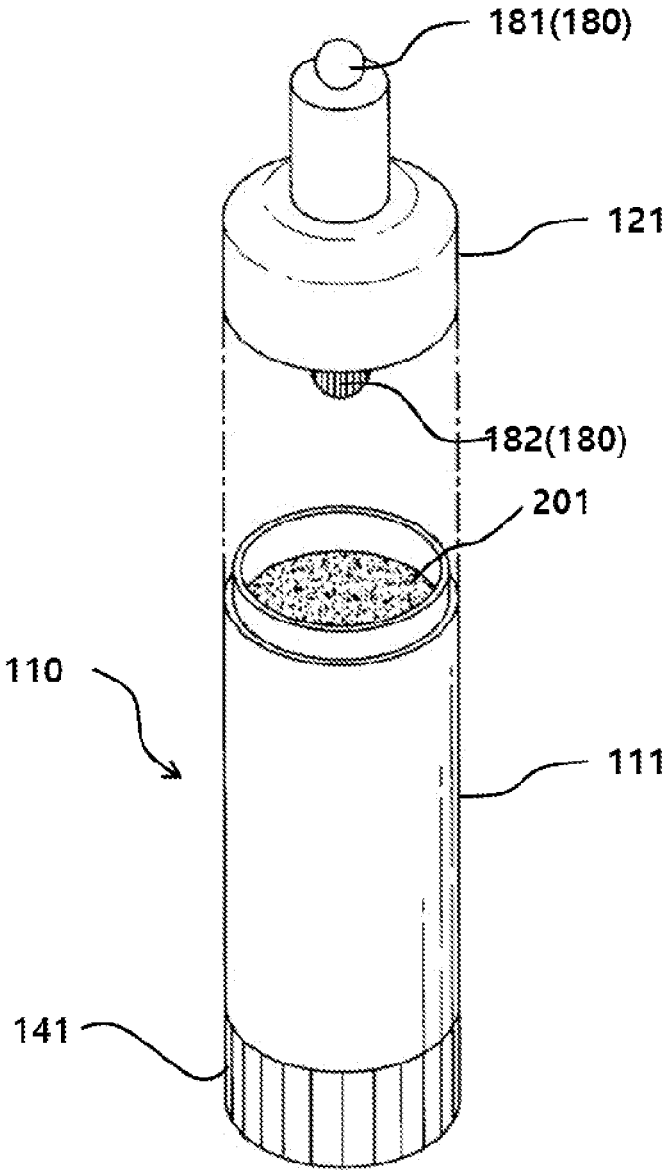
FIG. 12 PRIOR ART
FIG. 12 is an exploded perspective view of a conventional cosmetic container.
Figure 13:
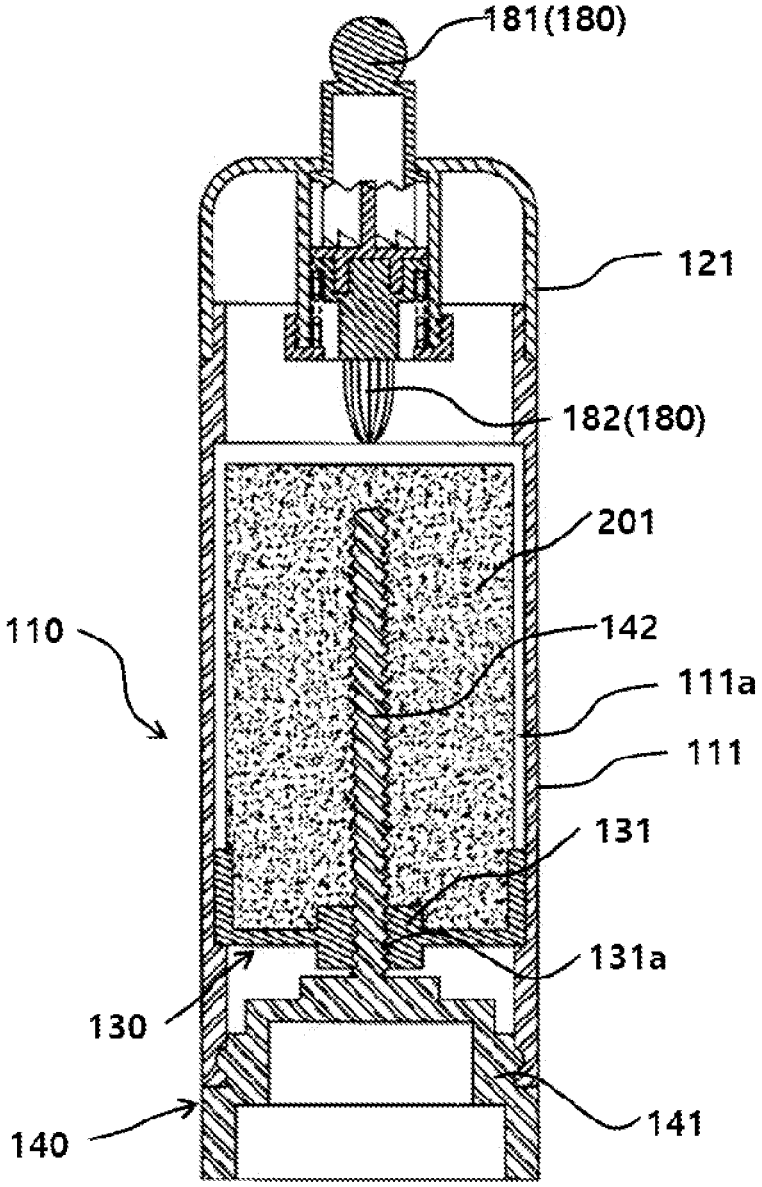
FIG. 13 PRIOR ART
FIG. 13 is a cross-sectional view of a conventional cosmetic container.

FIG. 1 and FIG. 2 are exploded perspective views of a cosmetic container according to an embodiment of the disclosure, respectively. FIG. 3 is a cross-sectional view of a cosmetic container according to an embodiment of the disclosure. FIG. 4 is a perspective view of a massage ball holder according to an embodiment of the disclosure. FIG. 5 is a front view of an upward/downward movement operation unit according to an embodiment of the disclosure. FIG. 6 is a perspective view of an upward/downward movement operation unit according to an embodiment of the disclosure. FIG. 7 is a plan view of an upward/downward movement operation unit according to an embodiment of the disclosure. FIG. 8 is a perspective sectional view taken along the line 8-8 of FIG. 7. FIG. 9 is a perspective sectional view taken along the line 9-9 of FIG. 7. FIG. 10 is a view illustrating the reinforcing wall area in FIG. 8. FIG. 11 is a view illustrating the reinforcing wall area in FIG. 9.

As illustrated in the drawings, a cosmetic container according to an embodiment of the disclosure includes a cosmetic container unit 10 including a cosmetic storage space unit 11 in which a concave cosmetic storage space 11*a* is formed, a ball-rolling support unit 90 provided at one end of the cosmetic container unit 10, a massage ball holder 70 coupled to one end of the cosmetic container unit 10, three massage balls 22 installed between the ball-rolling support unit 90 and the massage ball holder 70, a cosmetic container cap 21 installed to surround an upper opening of the cosmetic storage space unit 11, and a massage ball cap 23 installed to surround the massage ball 22.

The cosmetic container unit 10 has, in addition to the cosmetic storage space unit 11, a spiral tube accommodation space unit 12 having a tube shape extending downwards from a lower surface of the cosmetic storage space unit 11, a cosmetic holder 30 including a holder head unit 31 having a concave cross-section and installed at a bottom surface of the cosmetic storage space unit 11, and an upward/downward movement operation unit 40 coupled to the spiral tube accommodation space unit 12.

The cosmetic storage space unit 11 has a communication hole 11*b* formed to extend therethrough at the bottom surface thereof.

The spiral tube accommodation space unit 12 has a spiral tube accommodation space unit annular groove 12*a* formed at an outer surface thereof.

The cosmetic holder 30 has, in addition to the holder head unit 31, a holder body unit 32 extending from a bottom surface of the holder head unit 31.

The holder body unit 32 is formed to extend through the communication hole 11*b* so as to enter inside the spiral tube accommodation space unit 12.

The holder body unit 32 has a lifting guide protrusion 32*a* formed at the outer surface thereof.

The holder body unit 32 is formed to alternately have a curved surface section and a plane section wherein a cutting groove 32*c* is formed at a lower end of the plane section.

The upward/downward movement operation unit 40 has a rotation control tube unit 50, a spiral tube unit 60 including a spiral tube side unit 61 having a tube shape disposed in the rotation control tube unit 50 to form a concentric circle with the rotation control tube unit 50, and a spiral tube support unit 41 configured to support the spiral tube unit 60 with respect to the rotation control tube unit 50.

The rotation control tube unit 50 has a gripping tube unit 51, an upper fastening tube unit 52 extending upwards from an upper end of the gripping tube unit 51, a first lower fastening tube unit 53 extending downwards from a lower end of the gripping tube unit 51, and a second lower fastening tube unit 54 extending downwards from a lower end of the first lower fastening tube unit 53.

The upper fastening tube unit 52 has an upper fastening tube inner protrusion 52*a* formed on an inner surface thereof and an upper fastening tube outer protrusion 52*b* formed on an outer surface thereof.

The first lower fastening tube unit 53 has a first lower fastening tube protrusion 53*a* formed on an outer surface thereof.

The second lower fastening tube unit 54 has a pair of arc-shaped reinforcing wall units 54*c* formed on an inner surface thereof to face each other, and a second lower fastening tube concave groove 54*a* formed on an outer surface thereof.

The spiral tube unit 60 has, in addition to the spiral tube side unit 61, a spiral tube bottom surface unit 62 formed at a lower end of the spiral tube side unit 61.

The spiral tube side unit 61 has a spiral groove 61*a* formed on an inner surface thereof.

The spiral tube support unit 41 is configured to connect an inner surface of a reinforcing wall unit 54*c* and the spiral tube side unit 61.

The upward/downward movement operation unit 40 having the configuration described above is rotatably coupled to the spiral tube accommodation space unit annular groove 12*a* via the upper fastening tube inner protrusion 52*a*.

The upward/downward movement operation unit 40 is coupled such that the rotation control tube unit 50 is exposed to the outside, the spiral tube side unit 61 enters between the spiral tube accommodation space unit 12 and the holder body unit 32, and a lifting guide protrusion 32*a* enters a spiral groove 61*a*. As the lifting guide protrusion 32*a* enters the spiral groove 61*a*, the cosmetic holder 30 is moved upwards/downwards when rotating the rotation control tube unit 50 in a forward or reverse direction.

The ball-rolling support unit 90 has a circular tube-shaped ball support tube 91 extending from the spiral tube bottom surface unit 62 to be disposed along a longitudinal direction of the cosmetic container unit 10, and a ball support column 92 extending from the spiral tube bottom surface unit 62 to be disposed in the ball support tube 91.

The ball support tube 91 extends from the bottom of the spiral tube bottom surface unit 62 along a direction away from the spiral tube side unit 61.

The ball support tube 91 has a support tube ball support surface 91*a* formed at an upper end thereof and forming a downward inclination toward the ball support column 92.

The ball support column 92 is formed at a bottom of the spiral tube bottom surface unit 62 such that a circular ring-shaped ball-rolling support concave groove 90*a* is formed between the ball support column and the ball support tube 91. The ball-rolling support concave groove 90*a* has a groove width smaller than a diameter of the massage ball 22. The concave groove means a groove which is concave.

The ball support column 92 has a support column ball support surface 92*a* formed at an upper end thereof and forming a downward inclination toward the ball support tube 91.

The massage ball holder 70 has a circular tube-shaped ball holder fastening tube unit 71, a ball holder taper unit 72 extending from one end of the ball holder fastening tube unit 71 to have a cross-sectional area which gradually decrease therefrom, a ball support hole surface unit 73 extending from an end of the ball holder taper unit 72, and a holder thick plate unit 74 formed on an inner surface of the ball support hole surface unit 73.

The ball holder fastening tube unit 71 has a massage ball cap fastening tube protrusion 71*a* formed on an inner surface thereof.

Three ball support holes 73*a* are formed on the ball support hole surface unit 73. The ball support hole 73*a* is formed to penetrate the holder thick plate unit 74.

The ball support hole 73*a* has a diameter smaller than the diameter of the massage ball 22.

The massage ball holder 70 having the configuration described above is coupled to the rotation control tube unit 50 via the ball holder fastening tube unit 71 such that the ball support hole 73*a* is aligned to (face) the ball-rolling support concave groove 90*a*.

The massage ball holder 70 is coupled such that the massage ball cap fastening tube protrusion 71*a* is fastened to the second lower fastening tube concave groove 54*a*.

Each of the massage ball 22 is installed to roll in a state in which a partial area thereof is exposed to the outside through the ball support hole 73*a* and a part thereof is inserted in the ball-rolling support concave groove 90*a*.

The massage ball 22 may be made of stainless steel, aluminum, and the like.

The cosmetic container cap 21 has a container cap inner groove 21*a* formed on an inner surface thereof.

The cosmetic container cap 21 is coupled to the upper fastening tube outer protrusion 52*b* via the container cap inner groove 21*a*.

The massage ball cap 23 has a massage ball cap inner groove 23*a* formed on an inner surface thereof.

The massage ball cap 23 is coupled to the rotation control tube unit 50 to surround the massage ball holder 70.

The massage ball cap 23 is coupled such that the first lower fastening tube protrusion 53*a* is fastened to the massage ball cap inner groove 23*a*.

A method for using a cosmetic container according to an embodiment of the disclosure having the configuration described above will be described below.

When using a cosmetic, first, a user separates the cosmetic container cap 21 from the rotation control tube unit 50.

Figure 14:
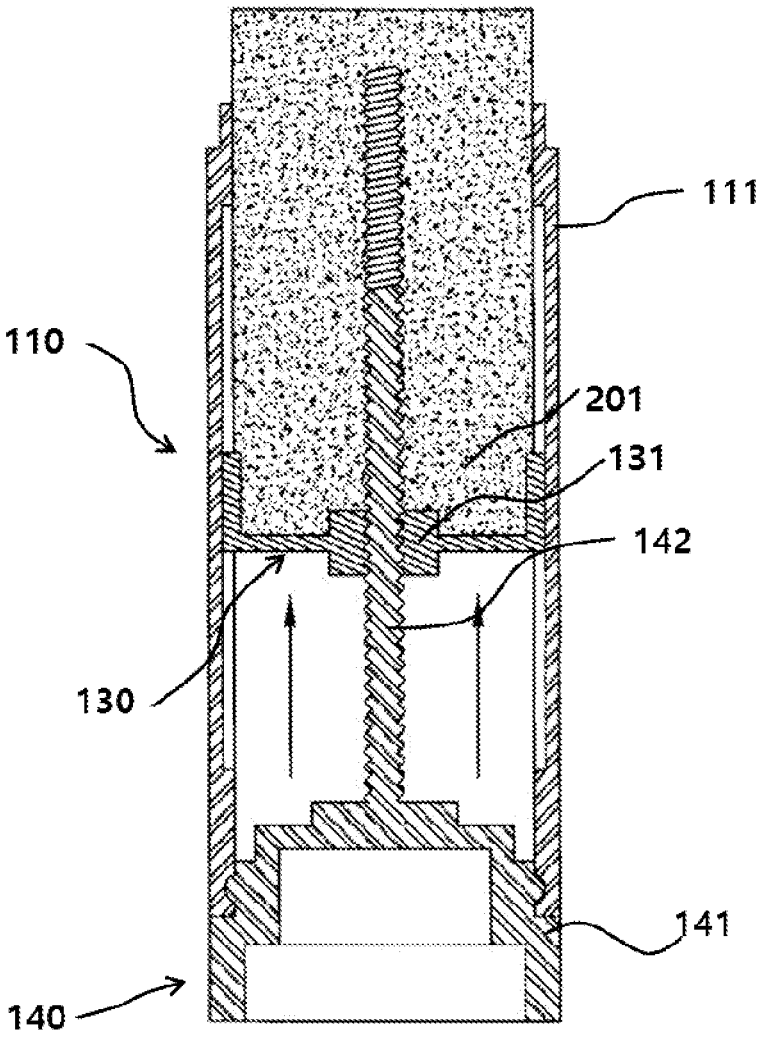
FIG. 14 PRIOR ART
FIG. 14 is a view illustrating a usage method of a conventional cosmetic container.

Next, the user grips the cosmetic storage space unit 11 and rotates the rotation control tube unit 50 to expose the cosmetic 201 (See FIG. 14) to the outside over the upper end of the cosmetic storage space unit 11.

The user makes up with the exposed cosmetic.

Next, the user grips the cosmetic storage space unit 11 and rotates the rotation control tube unit 50 in a reverse direction to insert the cosmetic into the cosmetic storage space unit 11.

Finally, the user couples the cosmetic container cap 21 to the rotation control tube unit 50.

Meanwhile, the massage ball cap 23 is separated from the rotation control tube unit 50 in a state in which the cosmetic container cap 21 is coupled to the rotation control tube unit 50. When the massage ball cap 23 is separated, the massage ball 22 is exposed to the outside.

Next, when the user brings the massage ball 22 into pressure contact with the skin and rolls the ball, the skin is physically stimulated, and a massage effect can be obtained. When the massage ball 22 is in pressure contact with the skin, the massage ball 22 is in contact with the support tube ball support surface 91*a* and the support column ball support surface 92*a*. The massage ball 22 rolls while being in contact with the support tube ball support surface 91*a* and the support column ball support surface 92*a*.

When the massage is over, the user couples the massage ball cap 23 to the rotation control tube unit 50.

As described above, according to an embodiment of the disclosure, the ball-rolling support unit 90 is provided at one end of the cosmetic container unit 10 to form the circular ring-shaped ball-rolling support concave groove 90*a*, and the massage ball holder 70 having the ball support hole surface unit 73 having at least one ball support hole 73*a* formed therein is coupled to the cosmetic container unit 10 such that the ball-rolling support concave groove 90*a* and the ball support hole 73*a* are aligned with each other. Meanwhile, the massage ball 22 is installed to roll in a state in which a part thereof is exposed to the outside through the ball support hole 73*a* and a part thereof is inserted into the ball-rolling support concave groove 90*a*, so that the massage ball 22 can be installed to have less friction while rolling and to be easily assembled and washed.

Furthermore, the ball-rolling support concave groove 90*a* is formed to have a circular ring shape so that an installation area of the massage ball 22 and a selective range of the number of the massage ball are widened, respectively.

The ball-rolling support unit 90 includes the circular tube-shaped ball support tube 91 formed at one end of the cosmetic container unit 10 to be disposed along a longitudinal direction of the cosmetic container unit 10, and the ball support column 92 formed at one end of the cosmetic container unit 10 to be disposed in the ball support tube 91 such that the ball-rolling support concave groove 90*a* is formed between the ball support tube 91 and the ball support column. Therefore, the space occupied by the ball-rolling support unit 90 can be reduced and the massage ball 22 can be in pressure contact with the skin with a relatively smaller force (pressing the massage ball along a longitudinal direction of the cosmetic container unit to bring the massage ball into contact with the skin).

In addition, the support tube ball support surface 91*a* is formed at the upper end of the ball support tube 91 and the support column ball support surface 92*a* is formed at the upper end of the ball support column 92, so that the rolling operation of the massage ball 22 can be stably maintained (the massage ball rolls while being in contact with the support tube ball support surface and the support column ball support surface).

In addition, the holder thick plate unit 74 is formed on an inner surface of the ball support hole surface unit 73 and the ball support hole 73*a* is formed to penetrate the holder thick plate unit 74, so that the rolling operation of the massage ball 22 is stably maintained (the distance between the outer surface of the massage ball and the inner circumferential surface of the ball support hole when the massage ball rolls is smaller than that in a case in which the holder thick plate unit is not provided).

BRIEF DESCRIPTION OF REFERENCE NUMERALS

10, 110: Cosmetic container unit
11, 111: Cosmetic storage space unit
21: Cosmetic container cap
22: Massage ball
23: Massage ball cap
30, 130: Cosmetic holder
31: Holder head unit
32: Holder body unit
40, 140: Upward/downward movement operation unit
41: Spiral tube support unit
50: Rotation control tube unit
60: Spiral tube unit
70: Massage ball holder
71: Ball holder fastening tube unit
72: Ball holder taper unit
73: Ball support hole surface unit
74: Holder thick plate unit
90: Ball-rolling support unit
91: Ball support tube
92: Ball support column

What is claimed is:

1. A cosmetic container having a cosmetic container unit including a cosmetic storage space unit in which cosmetic storage space is formed, the cosmetic container comprising:

a ball-rolling support unit provided at one end of the cosmetic container unit to form a circular ring-shaped ball-rolling support concave groove;

a massage ball holder which has a ball support hole surface unit having at least one ball support hole formed therein and is coupled to the cosmetic container unit such that the ball support hole is aligned to the ball-rolling support concave groove; and a massage ball installed to roll in a state in which a partial area thereof is exposed to an outside through the ball support hole and a part thereof is inserted in the ball-rolling support concave groove, wherein the ball-rolling support unit includes a circular tube-shaped ball support tube formed at one end of the cosmetic container unit to be disposed along a longitudinal direction of the cosmetic container unit, and a ball support column formed at one end of the cosmetic container unit to be disposed in the ball support tube such that the ball-rolling support concave groove is formed between the ball support tube and the ball support column.

2. The cosmetic container of claim 1, wherein the ball support tube has a support tube ball support surface formed at an upper end thereof and forming a downward inclination toward the ball support column, and the ball support column has a support column ball support surface formed at an upper end thereof and forming a downward inclination toward the ball support tube.

3. The cosmetic container of claim 2, wherein:

the massage ball holder further includes a holder thick plate unit formed on an inner surface of the ball support hole surface unit; and the ball support hole is formed to penetrate the holder thick plate unit.

4. The cosmetic container of claim 1, wherein:

the massage ball holder further includes a holder thick plate unit formed on an inner surface of the ball support hole surface unit; and the ball support hole is formed to penetrate the holder thick plate unit.

5. The cosmetic container of claim 1, wherein:

the massage ball holder further includes a holder thick plate unit formed on an inner surface of the ball support hole surface unit; and the ball support hole is formed to penetrate the holder thick plate unit.

* * * * *